US010815101B2

(12) United States Patent
Sutcliffe et al.

(10) Patent No.: US 10,815,101 B2
(45) Date of Patent: Oct. 27, 2020

(54) MANUAL MARINE WINCH WITH BIASED SAFETY HANDLE

(71) Applicant: W. W. Patterson Company, Pittsburgh, PA (US)

(72) Inventors: Mark Sutcliffe, Pittsburgh, PA (US); Brandon Cox, West Newton, PA (US); Taylor C. Grapes, Pittsburgh, PA (US)

(73) Assignee: W.W. PATTERSON COMPANY, Pittsburgh, PA (US)

( * ) Notice: Subject to any disclaimer, the term of this patent is extended or adjusted under 35 U.S.C. 154(b) by 322 days.

(21) Appl. No.: 15/926,196

(22) Filed: Mar. 20, 2018

(65) Prior Publication Data

US 2018/0273356 A1 Sep. 27, 2018

Related U.S. Application Data

(60) Provisional application No. 62/475,443, filed on Mar. 23, 2017.

(51) Int. Cl.
*B66D 1/06* (2006.01)
*B66D 5/34* (2006.01)

(52) U.S. Cl.
CPC *B66D 1/06* (2013.01); *B66D 5/34* (2013.01)

(58) Field of Classification Search
CPC ... B66D 1/06; B66D 5/32; B66D 1/00; B66D 1/02; B66D 1/04
See application file for complete search history.

(56) References Cited

U.S. PATENT DOCUMENTS

| | | | | |
|---|---|---|---|---|
| 2,630,298 | A * | 3/1953 | Hoehn | B66D 5/10 254/366 |
| 3,939,729 | A | 2/1976 | Brockelsby | |
| 4,106,754 | A | 8/1978 | Kucher | |
| 4,456,227 | A | 6/1984 | Notenboom | |
| 4,566,674 | A | 1/1986 | Ebey et al. | |
| 5,947,450 | A | 9/1999 | Grapes | |
| 6,431,525 | B1 | 8/2002 | Roll | |
| 6,572,083 | B1 | 6/2003 | Topping, Jr. et al. | |
| 6,726,182 | B2 | 4/2004 | Topping, Jr. et al. | |
| 6,938,881 | B2 | 9/2005 | Grapes | |
| 7,128,307 | B2 | 10/2006 | Dow | |
| 7,179,852 | B2 | 2/2007 | Schultes et al. | |

(Continued)

*Primary Examiner* — Sang K Kim
*Assistant Examiner* — Nathaniel L Adams
(74) *Attorney, Agent, or Firm* — Blynn L. Shideler; Krisanne Shideler; BLK Law Group

(57) ABSTRACT

A manual marine winch includes a winch housing; a rotating drum assembly supported on the housing; a winch line selectively spooled and un-spooled on the drum; a manually actuated control for spooling and un-spooling the winch line including a handle for selectively tensioning the drum and moveable between a position engaged with the drum for winch line tensioning and stowed position wherein the handle is not engaged with the drum; a tension holding mechanism comprising at least one ratchet gear coupled to the drum, at least one pawl selectively engaged with at least one ratchet gear to hold tension on the winch line, and a knockout configured to selectively disengage each of the pawls to allow for release of tension on the winch; and a biasing mechanism selectively engaged by the handle and configured to bias the handle toward the stowed position when the handle is engaged with the drum.

6 Claims, 3 Drawing Sheets

(56) References Cited

U.S. PATENT DOCUMENTS

| | | | |
|---|---|---|---|
| 7,543,800 | B2 | 6/2009 | Grapes et al. |
| 7,686,282 | B2 | 3/2010 | Amoss et al. |
| 9,004,456 | B2 | 4/2015 | Topping, Jr. et al. |
| 2012/0068132 | A1 | 3/2012 | Grapes et al. |

* cited by examiner

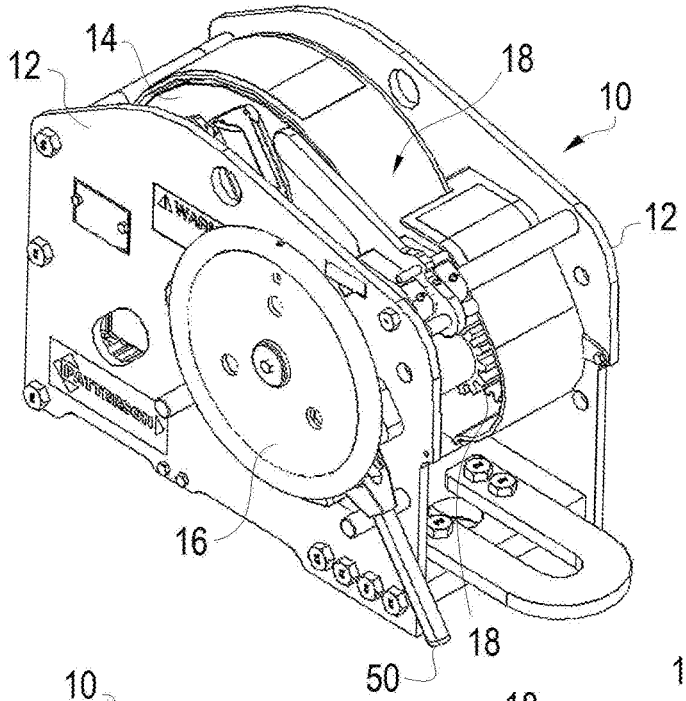
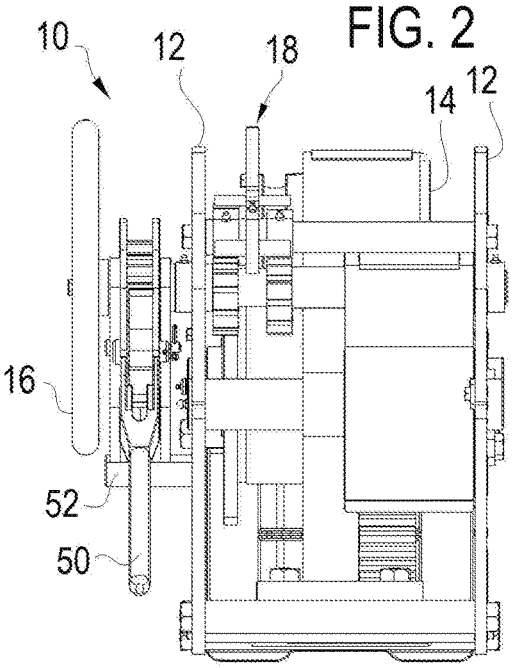
FIG. 2
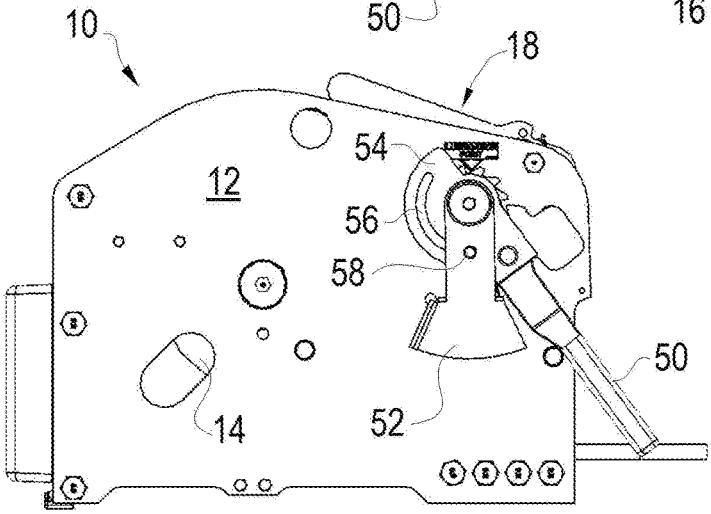
FIG. 3
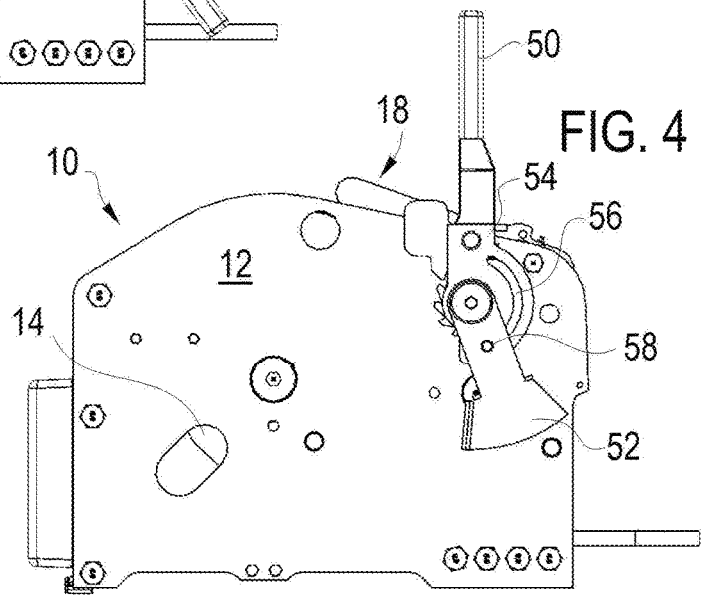
FIG. 4

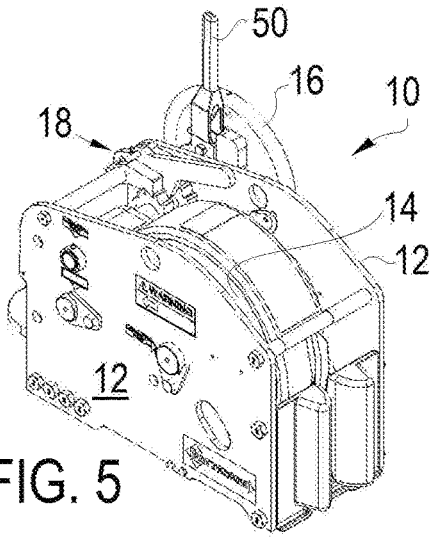
FIG. 5
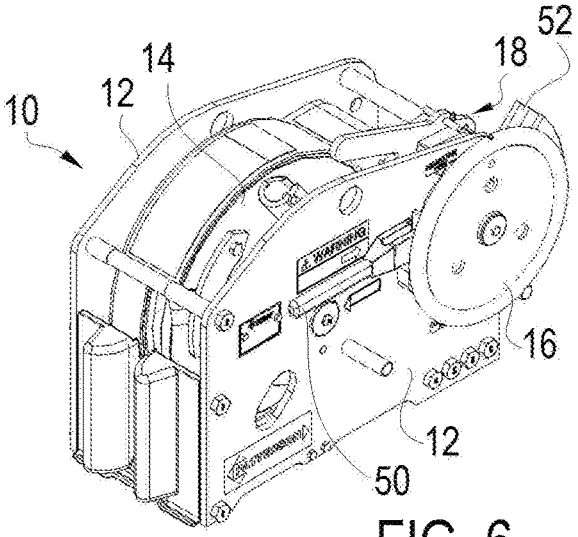
FIG. 6
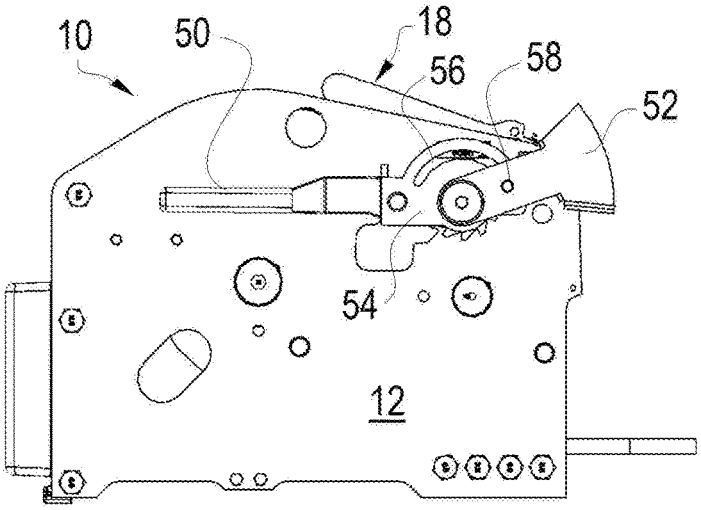
FIG. 7
FIG. 8
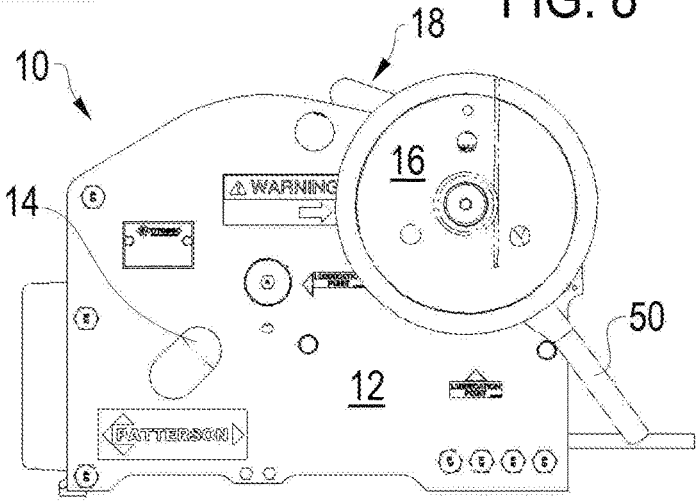

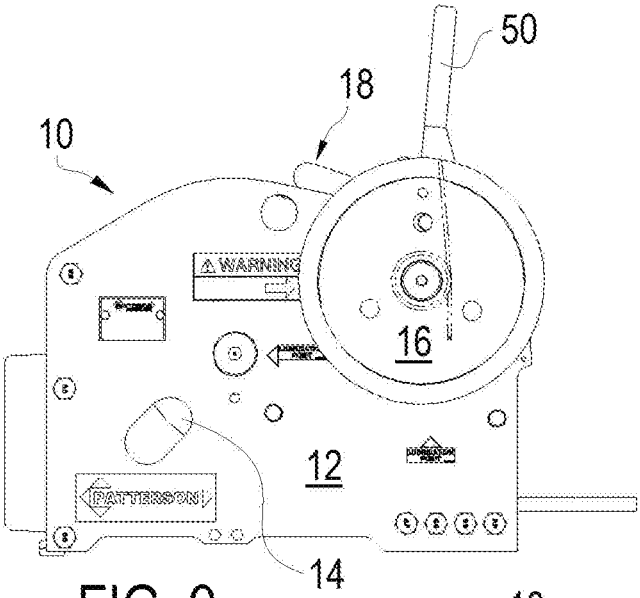
FIG. 9
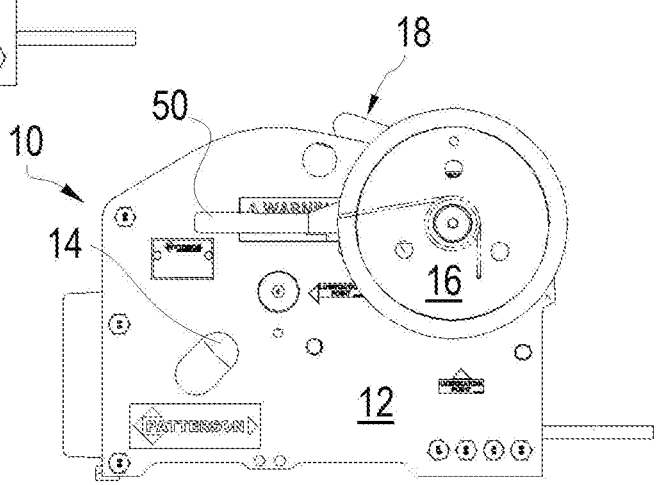
FIG. 10
FIG. 11A
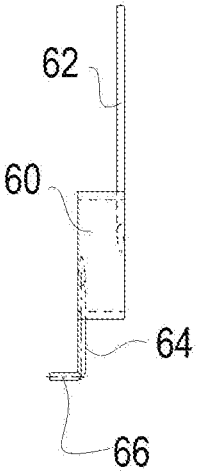
FIG. 11B
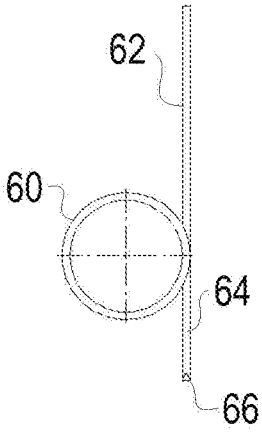
FIG. 11C
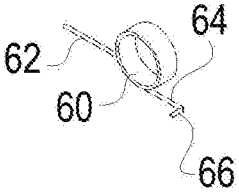

MANUAL MARINE WINCH WITH BIASED SAFETY HANDLE

RELATED APPLICATIONS

This application claims the benefit of U.S. Patent Application Ser. No. 62/475,443 filed Mar. 23, 2017 entitled "Manual Marine Winch with Biased Safety Handle" which application is incorporated herein.

BACKGROUND OF THE INVENTION

1. Field of the Invention

The present invention relates to manual winches with safety loading handles, more particularly, the present invention relates to manual marine winches with a biased safety loading handle configured to prevent improper storage of the safety handle.

2. Background Information

General Manual Marine Winches

Winches have been used in many applications. The present invention relates to manual winches which have been widely used in barges, tow boats and the like. Typically such a manual winch is attached to a boat deck and spools a towing cable or winch line on a rotating drum. In light of this use the manual winch is sometimes called a manual marine winch, a manual barge winch, manual boat winch or even marine winch, barge winch or boat winch The latter three terms can also be inclusive of powered, generally electric, winches.

Manual winches remain in common use where a powered winch would be impractical or inefficient. In a manual winch the operator, through various mechanical advantages, can generate a very large tension on the winch line. A representative examples of a manual winch are described in greater detail in U.S. Pat. No. 5,947,450 which is incorporated herein by reference. Examples of manual winches are sold by W. W. Patterson Company, Nabrico and Nashville Bridge Company. Other representative examples are found in U.S. Pat. Nos. 3,939,729; 4,106,754; 4,456,227; 4,566,674; 6,431,525; 6,572,083; 6,726,182; 6,938,881; 7,128,307; 7,179,852; 7,686,282, which are incorporated herein by reference.

A background summary of conventional winch design may be helpful to fully understand the scope and operation of the present invention.

The conventional prior art manual marine winch is described in U.S. Pat. No. 5,947,450 and includes a base plate and a pair of spaced side plates surrounding a rotatable spool or drum assembly. The rotatable spool assembly is rotationally supported between the side plates and includes a drum with a controlling gear. A control assembly is supported by the side plates and engages with the gear to rotate the drum for spooling of a cable (not shown) or wire rope or winch line thereon. The control assembly includes a hand wheel and an actuating lever or handle, also called a ratchet handle, each of which are used for manually operating the winch.

A foot brake may be attached to the side plate through which the control assembly extends. The foot brake, if provided, is adapted to frictionally engage the hand wheel. A swivel link may be attached to the base plate at a rear of the winch and pivotally attaches the winch to a D-ring of a boat deck or the like. The construction of the manual swivel winch may include the use of four tubular spacers for spacing the side plates apart. A bolt extends through the center of each spacer through aligned holes in the opposed side plates and is secured by nuts.

In a conventional marine winch a wire rope, the winch line, is spooled back and forth in most winch designs around the rotating drum and the winch line is subject to very large loads. The high loading can cause the outer layers of wire rope to become fouled, jammed or begin binding within the spaces between the lower level wire ropes. Further, rapid tension release in existing wire rope winch systems can result in what is known as "bird-nesting" of the spooled wire rope. This can make unwinding the winch very difficult in subsequent operation, and often requires a second deck hand to assist in the unwinding of the wire rope, or even the engine power of the tow boat.

U.S. Pat. No. 7,543,800 which is incorporated herein by reference addressed some of these problems with the prior art designs proposing the implementation of a "single stack" winch and available under YO-YO™ brand from applicant.

The conventional ratchet handle of all of the above described manual marine winches will typically have a stowed position, generally the rearward position, in which it is disengaged from the gearing associated with the drum. The stowed position may have a stop secured to the sidewall or side plate acting as a rest for the handle and a visual indicator that the handle is in the stowed position. As the handle is rotated away from the stowed position it will engage the gearing associated with the drum to allow for tensioning of the drum and associated winch line, in a conventional fashion known in the art.

The tension is held on ratchet gears that are engaged with pawls or locking dogs. In conventional tensioning operation for the winch the pawls are engaged with the ratchet gears and the operator will rapidly wind up the winch line, and increase the tension, initially through the operation of the hand wheel. Once the tension reaches a relatively high amount on the winch line, the operator will continue the tensioning through the repeated use of the ratchet handle, often with the use of a handle extension or a "cheater bar" to add increased leverage. A typical "cheater bar" is a 3-4' metal pipe that can fit over the handle and extend its length. Once the final tension is achieved it is intended for the operator to move the handle to the disengaged or stowed position, typically the rearward position, to prepare the winch for tension release when desired.

A knockout lever, also known in the art, is used to disengage the pawls or dogs from the gears to release tension on the winch, when desired. When controlled payout is desired the footbrake, if provided, is engaged (or the hand wheel is gripped) and the knockout lever is utilized to disengage the pawls or dogs from the gears to allow for slow payout. Often the tension release is allowed to be somewhat rapid. The knockout lever is so named as it is often struck to be knocked out of engagement.

The manual tensioning handles of known marine winches should be disengaged to allow for safe unloading or payout of the winch line. If the tension is released on the drum through a knockout device with the handle still accidentally engaged, the handle will rotate, through the gearing, with the drum. In such a case, with the drum under high loads or tension, the accidentally drum-engaged handle can be rotated quite fast and violently before striking a rear stop or the ship's deck. Aside from damaging the handles in this movement, of far greater concern is the potential injury to workers around the winch during such accidental winch handle movement.

The danger of unintended handle movement is significantly heightened if a handle extension, also called a cheater bar, is left on the handle that is left engaged with the gearing. As noted above a cheater bar is typically a length of pipe that operators add to the manual marine winch handle to increase the effective lever arm available to the operator for ease of tensioning the winch. Operators have broken arms and legs due to such undesired violent handle and cheater bar motion during knockout operation.

U.S. Patent Application Publication No. 2012-0068132, which is incorporated herein by reference, provides one solution to this handle problem with the design of a manual marine winch that includes a self releasing handle. The handle includes i) a ratchet gear coupled to the drum wherein rotation of the ratchet gear will cause rotation of the drum, ii) a rotating handle body with a manual end grip, iii) a user engaged trigger mechanism on the end grip moveable between an engaged position and a release position, and iv) a handle locking pawl on the handle body and coupled to the trigger mechanism and moveable between a position engaged with the ratchet gear rotationally securing the handle body to the ratchet gear and the drum when the trigger is in the engaged position and a position disengaged with the ratchet gear rotationally separating the handle body from the ratchet gear and the drum when the trigger is not in the engaged position. The self-releasing handle of U.S. Patent Application Publication No. 2012-0068132 represents a relatively complex handle and thus may not be adopted by all winch users. No matter how effective a safety feature may be, it is utterly useless if it remains in the storeroom and unimplemented.

U.S. Pat. No. 9,004,456 also addresses this issue and discloses a manual marine winch that includes a safety knockout override preventing release of winch tension without the handle in stowed position. The winch includes a housing; a rotating drum on the housing; a winch line on the drum; a control for spooling and un-spooling the winch line on the drum, wherein the control includes a handle for selectively tensioning the drum and moveable between a position engaged with the drum and a disengaged stowed position; a tension holding mechanism on the housing comprising a ratchet gear coupled to the drum, a pawl selectively engaged with the ratchet gear, and a knockout configures to selectively disengage the pawl from the gear to allow for release of winch tension; and a safety knockout override coupled to the housing and selectively engaged by the handle and configured to prevent release of winch tension when the handle is not in the stowed position The safety knockout override of U.S. Pat. No. 9,004,456 also represents a relatively complex design and thus may not be adopted by all winch users.

Thus there remains a need for preventing undesired handle movement during tension release on manual marine winches with the operation of a knockout device and to increase the options to the users for such safety features, such that they can adopt one of their preference. It is an object of the present invention to minimize the drawbacks of the existing manual winch handles and to provide a simple easy and safe marine winch.

SUMMARY OF THE INVENTION

The various embodiments and examples of the present invention as presented herein are understood to be illustrative of the present invention and not restrictive thereof and are non-limiting with respect to the scope of the invention.

A manual marine winch according to the invention includes a winch housing; a rotating drum assembly supported on the winch housing; a winch line selectively spooled and un-spooled on the drum; a manually actuated control for spooling and un-spooling the winch line on the drum, wherein the manually actuated control includes a handle for selectively tensioning the drum and moveable between a position engaged with the drum in at least one rotational direction for tensioning of the winch line on the drum and stowed position wherein the handle is not engaged with the drum; a tension holding mechanism on the winch housing comprising at least one ratchet gear coupled to the drum, at least one pawl selectively engaged with at least one ratchet gear to hold tension on the winch line on the drum, and a knockout configured to selectively disengage each of the pawls from the gears to allow for release of tension on the winch; and a biasing mechanism selectively engaged by the handle and configured to bias the handle toward the stowed position when the handle is engaged with the drum. The biasing mechanism may be formed as a counterweight configured to be engaged with the handle when the handle is engaged with the drum. Alternatively the biasing mechanism may be formed as a spring configured to be engaged with the handle when the handle is engaged with the drum.

These and other advantages of the present invention will be clarified in the brief description of the preferred embodiment taken together with the drawings in which like reference numerals represent like elements throughout.

BRIEF DESCRIPTION OF THE DRAWINGS

FIG. 1 is a perspective view of a single stack manual marine winch with a counterweight biased handle according to one aspect of the present invention;

FIG. 2 is a perspective rear end view of the single stack manual marine winch with a counterweight biased handle according to FIG. 1;

FIG. 3 is a side elevational view of the single stack manual marine winch with a counterweight biased handle according to FIG. 1 with the hand wheel omitted for clarity;

FIG. 4 is a side elevational view of the single stack manual marine winch with a counterweight biased handle according to FIG. 1 with the hand wheel omitted for clarity with the handle beginning engagement with the counterweight biasing mechanism;

FIG. 5 is a perspective of the single stack manual marine winch with a counterweight biased handle according to FIG. 3;

FIG. 6 is a perspective view of the single stack manual marine winch with a counterweight biased handle according to FIG. 1 with the handle in an operative tensioning position;

FIG. 7 is a side elevational view of the single stack manual marine winch with a counterweight biased handle according to FIG. 6 with the hand wheel omitted for clarity;

FIG. 8 is a side elevational view of a single stack manual marine winch with a spring biased handle according to another aspect of the present invention;

FIG. 9 is a side elevational view of the single stack manual marine winch with a spring biased handle according to FIG. 8 with the handle beginning engagement with the spring biasing mechanism;

FIG. 10 is a side elevational view of the single stack manual marine winch with a spring biased handle according to FIG. 8 with the handle in an operative tensioning position;

FIGS. 11A-C are views of the spring biasing mechanism for the single stack manual marine winch according to FIG. 8.

DESCRIPTION OF THE PREFERRED EMBODIMENTS

The present invention is directed to a manual marine winch 10 with a safety handle 50 which includes a biasing mechanism, such as a counterweight or a spring or combinations thereof, selectively engaged by the handle and configured to bias the handle toward the stowed position when the handle is engaged with the drum.

FIGS. 1-7 illustrate a single stack manual marine winch with a counterweight biased handle according to one aspect of the present invention. FIGS. 8-10 illustrate a single stack manual marine winch with a spring biased handle according to one aspect of the present invention. The invention may be implemented upon other winch drum designs other than a single stack.

The general details of the single stack winch 10 of the invention, outside of the biased safety handle 50, are described in U.S. Pat. No. 7,543,800 which is incorporated herein by reference. The winch includes a pair of spaced side plates 12 defining an open bottom. A rotating spool assembly 14 is supported between the side plates 12 and includes drum generally with a protecting flange on one side of the drum and a controlling drum gear on the other side of the drum.

The rotating spool assembly 14 includes, adjacent the drum gear, a stacking flange which is spaced from the drum gear a distance sufficient to receive only a single width of winch line to form a single stack wire rope stacking space that avoids fouling, binding jamming and the like. The stacking flange and the drum gear form the wire rope stacking space on the drum for storing a single stack of wire rope. The "single stack" defines that the each layer of wire rope within the stacking space is only a single wire rope. Through the formation of a single stack the winch 10 prevents unwanted binding during loading, preventing the jamming during the unwinding.

The winch 10 includes a hand wheel 16 and lever tension mechanism formed by the safety handle 50. The hand wheel 16 and the safety handle 50 are used to rotate the drum gear of the rotating spool assembly 14 through gearing assembly 18 in a conventional fashion. The gearing assembly 18 for the purpose of this application may be considered as the gear train including ratchet gears driven by the hand wheel 16 and the safety handle 50, and pawls or locking dogs and a knockout mechanism. The tension on the rotating spool assembly 14 is held on ratchet gears of the gearing assembly 18 that are engaged by pawls (also called locking dogs) of the gearing assembly 18. In conventional tensioning operation for the winch 10, the pawls of the gearing assembly 18 are engaged with the ratchet gears and the operator will rapidly wind up the winch line of the winch 10, and increase the tension, initially through the operation of the hand wheel 16. Once the tension reaches a relatively high amount on the winch line of the winch 10, the operator will continue the tensioning through the repeated use of the ratchet or safety handle 50, often with the use of a handle extension or a "cheater bar" to add increased leverage.

The release of winch 10 tension can be also referenced as "paying out", "unspooling", "unwinding" of the winch line, and is used herein to reference the act of actuating the knock-out of the gearing assembly 18 to disengage the pawls (also called locking dogs) of the gearing assembly from the gearing. The drum tension of the rotating spool assembly 14 in this release of winch tension may actually be maintained by a foot brake or hand brake or via a secure gripping of the hand wheel 16 by the operator. Often the tension release is allowed to be somewhat rapid. The knockout lever of the gearing assembly 18 is so named as it is often struck to be knocked out of engagement.

As noted above, in a conventional manual winch, once the final tension is achieved it is intended for the operator to move the handle to the disengaged or stowed position, typically the rearward position as shown in orientation of the attached figures, to prepare the winch for tension release when desired. If the tension is released on the drum through a knockout device in such a conventional winch design with the handle still accidentally engaged, the handle naturally will rotate, through the gearing, with the drum. In such a case, with the drum under high loads or tension, the accidentally drum-engaged handle can be rotated quite fast and violently before striking a rear stop or the ship's deck. Damaging the handles in this movement in one concern, but of far greater concern is the potential injury to workers around the winch during such accidental winch handle movement. Again as noted above, the danger of unintended handle movement is only heightened if a handle extension, also called a cheater bar, is left on the handle that is left engaged with the gearing.

The key aspect of the present invention is the provision of the biasing mechanism selectively engaged by the handle 50 and configured to bias the handle 50 toward the stowed position when the handle 50 is engaged with the tension on the rotating spool assembly 14. The handle 50 and the biasing mechanism combine to form a safety handle 50 for the winch 10.

In the embodiment of the invention shown in FIGS. 1-7 the biasing mechanism selectively engaged by the handle 50 includes a counterweight 52 selectively engaged by the handle 50. Specifically the counterweight 52 is rotationally supported on the pivot axis of the handle 50 to rotate about the axis. The selective engagement between the handle 50 and the counterweight 52 is accomplished via a plate 54 with an arcuate slot 56 carried by the handle 50 and an associated pin 58 on the counterweight 52, although the plate 54 with slot 54 and pin 58 coupling may be easily reversed (e.g., the plate 54 and slot 56 carried on the counterweight 52 and the pin 58 carried by the handle 50).

As shown the pin 58 and slot 56 allows the handle 50 to move freely, without associated movement or effect of the counterweight 52 from the rest position on the stop to slightly before a vertical position of the handle 52 and before the handle 52 is engaged with the with the tension on the rotating spool assembly 14 (also known as being engaged with the drum). Following movement of the handle 50 from the rest, stored, or out of engaged position to the operative position, once end of the slot 56 reaches the pin 58 (or vice versa if the plate 54 and pin 58 are reversed), then further movement of the handle 50 will rotate and lift the counterweight 52. The weight of the counterweight 52 is selected such that at any position of the handle 52 engaged with the drum (including the weight of a conventional length cheater bar) the weight of the counterweight 52 provides sufficient rotational torque to the handle 50 (via the pin 58 and the plate 54) to return the handle 50 to the over-center disengaged position in which gravity can allow the handle 50 to drop to the rest stop. The over center position shown in FIG. 5-6 is a disengaged position where the handle 50 is disengaged from the drum AND the handle 50 is disengaged from the counterweight. It should be readily apparent that the torque on the handle 50 by the counterweight 52 causing the handle 50 to move is a small fraction of the torque on a prior art inappropriately engaged handle (a handle inadvertently left in the engaged position with the drum) when tension has been released on the winch, whereby the counterweight 52 induced automatic handle 50 movement of the present invention is not rapid, forceful or violent and presents no significant danger to users or those nearby.

The user should still return the handle 50 to the stored position with the present invention, but if they neglect to do so the counterweight 52 will automatically return the handle 50 to the disengaged position upon release of the handle 50. Additionally the counterweight 52 is designed to not significantly affect the operation of the handle 50. The user will not feel the weight of the counterweight 52 at all until the end of the slot 56 reaches the pin 58 with the handle 50 near vertical as shown, thus the user does not have to lift the full weight of the handle 50 and the counterweight 52. The counterweight 52 is first engaged after much of the weight of the handle 50 is being carried by the axle due to the near vertical position of the handle 50. The operation of the handle 50 is not significantly changed from the user's perspective. The only perceived difference to the user is a slight upward pressure against the user's hands of the handle 50 (due to the effect of the then engaged counterweight 52) in the operative position as opposed to the downward pressure of prior art handles due to the (non-counteracted weight of the prior art handle in the operative position. In fact, the upward pressure may be less than the weight of the handle 50 making handle 50 manipulation in the operative position during winch tensioning technically easier in the present invention, however this is not the principle advantage to the system of the present invention.

The counterweight biased handle 50 of the present invention is easy to retrofit into prior art designs. Further, it does not change the standard operation of the winch 10 such that no new operational steps need to be learned by users. The present design does not add any difficulty in any of the operational steps of the winch 10 operation. The present invention provides a passive system to prevent unwanted tension payout with the handle 50 engaged.

FIGS. 8-10 illustrate a distinct mechanism selectively engaged by the handle 50 and configured to bias the handle toward the stowed position when the handle is engaged with the drum. In the embodiment of the invention shown in FIGS. 8-10 the biasing mechanism selectively engaged by the handle 50 includes a spring 60 selectively engaged by the handle 50, with the details of the spring 60 shown in FIGS. 11A-C. Specifically a coil type spring 60 is supported on the pivot axis of the handle 50 with a fixed leg 62 secured in position and a selectively engaged leg 64 with engagement end 66 configured for movement and loading or compression of the spring 60. The selective engagement between the handle 50 and the spring 60 is accomplished via the extension formed by engagement end 66 of the selectively engaged leg 64 that extends into the plane of movement of the handle 50.

The spring 60, analogous to the counterweight 52 in the earlier embodiment, allows the handle 50 to move freely, without associated movement or compression of the spring 60, from the rest position on the stop to slightly before vertical and before the handle 50 is engaged with the selectively engaged leg 64 of the spring 66. During movement of the handle 50 from the rest, stored or out of engaged position to the operative position, once the handle 50 reaches the engagement end 66 of the selectively engaged leg 64, then further movement of the handle 50 will rotate and compress/tension the spring 60. The spring force of the spring 60 is selected such that at any position of the handle 50 engaged with the drum (including the weight of a cheater bar) the spring force of the spring 60 provides sufficient rotational torque to the handle 50 (via the selectively engaged leg 64) to return the handle 50 to the over-center disengaged position in which gravity can allow the handle 50 to drop to the rest stop. The torque on the handle 50 by the spring 60 causing the handle 50 to move is a small fraction of the torque on a prior art inappropriately engaged handle when tension has been released on the winch, whereby the spring 60 induced handle 50 movement of the present invention is not rapid, forceful or violent and presents no significant danger to users or those nearby.

The user should still return the handle 50 to the stored position with the present invention, but if they neglect to do so the spring 60 will automatically return the handle 50 to the disengaged position upon release of the handle 50. Additionally the spring 60 is designed to not significantly affect the operation of the handle 50. The user will not feel the force of the spring 60 until the handle 50 engages the selectable engaged leg 64 with the handle 50 near vertical as shown, thus the user does not have to lift the full weight of the handle 50 and oppose the force of the spring 60. The spring 60 is first engaged after much of the weight of the handle 50 is being carried by the axle due to the near vertical position of the handle 50. The operation of the handle 50 is not significantly changed from prior art manual winches from the user's perspective. The only perceived difference to the user is an upward pressure against the user's hands of the handle 50 in the operative position (due to action of the engaged spring 60) as opposed to the downward pressure of prior art handles due to the weight of the prior art handle in the operative position. As with the initial embodiment, the upward pressure may be less than the weight of the handle 50 making handle 50 manipulation in the operative position during winch tensioning easier in the present invention, however this is not the principle advantage to the system of the present invention.

The spring 60 biased handle 50 of the present invention is also easy to retrofit into prior art winch designs. Further, it does not change the standard operation of the winch such that no new operational steps need to be learned by users. The present design does not add any difficulty in any of the operational steps of the winch operation. The present invention provides a passive system to prevent unwanted tension payout with the handle engaged.

The two illustrated designs are intended to show some of the variety of the present invention, each of which may be retrofitted into existing winches in the field. The invention could incorporate a combination of the two, namely a spring assisted counterweight biasing system.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention is defined in the appended claims and equivalents thereto.

What is claimed is:

1. A manual marine winch comprising:

a winch housing;

a rotating drum assembly supported on the winch housing;

a winch line selectively spooled and un-spooled on the drum assembly;

a manually actuated control for spooling and un-spooling the winch line on the drum assembly, wherein the manually actuated control includes a handle for selectively tensioning the drum assembly and moveable between a position engaged with the drum assembly in at least one rotational direction for tensioning of the winch line on the drum assembly and stowed position wherein the handle is not engaged with the drum assembly;

a tension holding mechanism on the winch housing comprising at least one ratchet gear coupled to the drum assembly, at least one pawl selectively engaged with a ratchet gear of said at least one ratchet gear to hold tension on the winch line on the drum assembly, and a knockout configured to selectively disengage each of the pawls from the engaged ratchet gear to allow for release of tension on the winch; and a biasing mechanism selectively engaged by the handle and configured to bias the handle toward the stowed position when the handle is engaged with the drum, wherein the biasing mechanism includes a counterweight configured to be engaged with the handle when the handle is engaged with the drum assembly, wherein the counterweight is configured to engage the handle before a vertical position of the handle is reached and before the handle is engaged with the drum, and wherein the engagement between the counterweight and the handle is via an arcuate slot and pin connection.

2. The manual marine winch according to claim 1 wherein the slot is formed in a plate carried by the handle and the pin is carried on the counterweight.

3. The manual marine winch according to claim 2 wherein the weight of the counterweight provides sufficient rotational torque to the handle and a conventional cheater bar to return the handle to an over-center disengaged position in which gravity can allow the handle to drop to a rest position.

4. A manual marine winch comprising:

a winch housing;

a rotating drum assembly supported on the winch housing;

a winch line selectively spooled and un-spooled on the drum;

a manually actuated control for spooling and un-spooling the winch line on the drum, wherein the manually actuated control includes a handle for selectively tensioning the drum and moveable between a position engaged with the drum in at least one rotational direction for tensioning of the winch line on the drum and stowed position wherein the handle is not engaged with the drum;

a tension holding mechanism on the winch housing comprising at least one ratchet gear coupled to the drum, at least one pawl selectively engaged with a ratchet gear of the at least one ratchet gear to hold tension on the winch line on the drum, and a knockout configured to selectively disengage each of the pawls from the engaged gear to allow for release of tension on the winch; and a counterweight configured to be selectively engaged by the handle and configured to bias the handle toward the stowed position when the handle is engaged with the drum, wherein the counterweight is configured to engage the handle before a vertical position of the handle is reached and before the handle is engaged with the drum, and wherein the engagement between the counterweight and the handle is via an arcuate slot and pin connection.

5. The manual marine winch according to claim 4 wherein the slot is formed in a plate carried by the handle and the pin is carried on the counterweight.

6. The manual marine winch according to claim 5 wherein the weight of the counterweight provides sufficient rotational torque to the handle and a conventional cheater bar to return the handle to an over-center disengaged position in which gravity can allow the handle to drop to a rest position.

* * * * *